United States Patent [19]

Mitsumaru et al.

[11] Patent Number: 4,824,324

[45] Date of Patent: Apr. 25, 1989

[54] WATER PUMP

[75] Inventors: Michitoshi Mitsumaru; Keiichi Furukawa; Teruo Ojima; Shiro Sawa, all of Osaka, Japan

[73] Assignee: Koyo Seiko Co., Ltd., Osaka, Japan

[21] Appl. No.: 188,530

[22] Filed: Apr. 29, 1988

[30] Foreign Application Priority Data

| | | | |
|---|---|---|---|
| May 1, 1987 | [JP] | Japan | 62-109364 |
| Aug. 17, 1987 | [JP] | Japan | 62-204542 |
| Aug. 17, 1987 | [JP] | Japan | 62-204544 |
| Aug. 17, 1987 | [JP] | Japan | 62-204543 |

[51] Int. Cl.[4] ..... F04D 29/08

[52] U.S. Cl. ..... 415/170 A; 416/60; 417/362; 123/41.44

[58] Field of Search ..... 415/170 A, 121 G; 416/60; 123/41.44; 417/362

[56] References Cited

U.S. PATENT DOCUMENTS

| | | | |
|---|---|---|---|
| 2,955,748 | 10/1960 | Killian | 416/60 |
| 3,861,170 | 11/1972 | Asberg | 64/3 |
| 3,871,790 | 3/1974 | Rameau | 415/219 |
| 3,934,966 | 6/1974 | Asberg | 415/219 |
| 3,981,610 | 10/1974 | Ernst et al. | 415/291 |
| 4,138,901 | 2/1979 | Fortin et al. | 416/60 |
| 4,215,658 | 8/1980 | Smith, Jr. et al. | 123/41.44 |
| 4,380,416 | 4/1983 | Menager | 415/170 A |
| 4,715,780 | 12/1987 | Kan | 415/170 A |
| 4,768,923 | 9/1988 | Baker | 415/170 A |

FOREIGN PATENT DOCUMENTS

| | | | |
|---|---|---|---|
| 2591299 | 6/1987 | France | 123/41.44 |

*Primary Examiner*—Robert E. Garrett
*Assistant Examiner*—John T. Kwon
*Attorney, Agent, or Firm*—Armstrong, Nikaido, Marmelstein, Kubovcik & Murray

[57] ABSTRACT

A water pump comprising a pump shaft having an impeller and mounted on one end of a pump housing with a seal provided therebetween, a stationary shaft in alignment with the pump shaft and supported at its one end by the other end of the pump housing, a pulley for reeving a belt therearound provided around the outer ring of an antifriction bearing mounted around the stationary shaft within the housing, and a water-tight flange positioned between the seal and the bearing and fixedly provided between the end portion of the pump shaft and the end portion of the pulley.

8 Claims, 12 Drawing Sheets

WATER PUMP

BACKGROUND OF THE INVENTION

The present invention relates to water pumps, for example, for motor vehicles.

Water pumps for motor vehicles are known which comprise a pump housing to be fixed to the body of an engine, an antifriction bearing having its outer ring press-fitted in the housing, a pump shaft attached to the inner ring of the antifriction bearing and having an impeller fixed thereto at its one end inside the engine body, a pulley mounted on the pump shaft at the other end thereof outside the engine body, and a mechanical seal provided between the housing and the pump shaft and positioned between the antifriction bearing and the impeller. By driving the pulley with a belt, the impeller is rotated to circulate cooling water.

However, the conventional water pump described has no partition between the antifriction bearing and the mechanical seal, so that the water passing through the mechanical seal exerts a direct influence on the bearing to cause damage to the water pump. Stated more specifically, the mechanical seal portion develops heat through friction because of the construction of the seal, allowing the heat to vaporize water in the vicinity of the seal portion and permitting the water vapor to pass through the seal. The water vapor passing through the mechanical seal immediately condenses to water droplets, which adhere to the end face of the antifriction bearing opposed to the seal. Thus, water passes through the mechanical seal and enters the bearing. Consequently, the bearing becomes damaged owing to corrosion or improper lubrication to render the water pump inoperative. Further since the pulley is fixed to the end of the pump shaft to place a load on the shaft end, a bending force acts on the bearing and adversely affects the life of the bearing.

OBJECT OF THE INVENTION

The main object of the present invention is to provide a water pump which is completely free of the likelihood that the water passing through the seal will ingress into the antifriction bearing.

SUMMARY OF THE INVENTION

A water pump of the invention comprises a pump shaft having an impeller and mounted on one end portion of a pump housing with a seal provided therebetween, a stationary shaft in alignment with the pump shaft and supported at its one end by the other end portion of the pump housing, a pulley for reeving a belt therearound provided around the outer ring of an antifriction bearing mounted around the stationary shaft within the housing, and a watertight flange positioned between the seal and the antifriction bearing and fixedly provided between the end portion of the pump shaft and the end portion of the pulley.

The water pump is of the type wherein the outer ring of the antifriction bearing is rotatable, such that the belt, when driven, rotates the pulley on the outer ring of the bearing, causing the watertight flange to rotate the pump shaft.

The watertight flange completely prevents water from ingressing into the antifriction bearing through the seal. Since the pulley is positioned radially outwardly of the bearing, the load acts on the bearing approximately at its center, precluding a bending force from acting on the bearing. This assures the bearing of a prolonged life and improved reliability.

According to a preferred embodiment of the invention, the pump shaft, the watertight flange and the pulley are formed integrally, for example, by press work. The outer ring of the antifriction bearing may be provided inside the pulley integrally therewith.

According to another preferred embodiment, the pump shaft, the watertight flange and the outer ring of the antifriction bearing are formed integrally, for example, by press work. The pulley may be provided around the outer ring of the antifriction bearing integrally therewith.

According to another preferred embodiment, the pulley is prepared separately from, and integrally secured to, the outer ring of the antifriction bearing, and the watertight flange is prepared separately from the outer ring of the bearing and the pulley and is integrally secured to the outer ring and/or the pulley. The pump shaft having an impeller is fixedly provided on the watertight flange.

The impeller and the pump shaft may be prepared integrally by press work.

The inner ring of the antifriction bearing may be provided around the stationary shaft integrally therewith.

According to another preferred embodiment, the pump housing has a peripheral wall which is partly cut out, and the belt is inserted in the pump housing through the cutout portion and reeved around the pulley. Alternatively, the belt may be passed around the pump housing and reeved around the pulley over the portion thereof left uncovered with the housing at the cutout portion.

The present invention further provides a water pump comprising a pump shaft having an impeller and mounted on one end portion of a pump housing with a seal provided therebetween, a stationary sleeve positioned around the pump shaft and supported at its one end by the other end portion of the pump housing, an antifriction bearing provided between the stationary sleeve and the pump shaft, a watertight flange positioned between the seal and the antifriction bearing and fixedly provided on the pump shaft, and a pulley for reeving a belt therearound fixedly provided at the outer peripheral portion of the watertight flange.

This water pump is of the type wherein the inner ring of the antifriction bearing is rotatable, such that the belt, when driven, rotates the pulley, which in turn causes the watertight flange to rotate the pump shaft on the inner ring side of the antifriction bearing.

The inner ring of the antifriction bearing may be provided integrally with the pump shaft.

DESCRIPTION OF THE PREFERRED EMBODIMENTS

Figure 1:
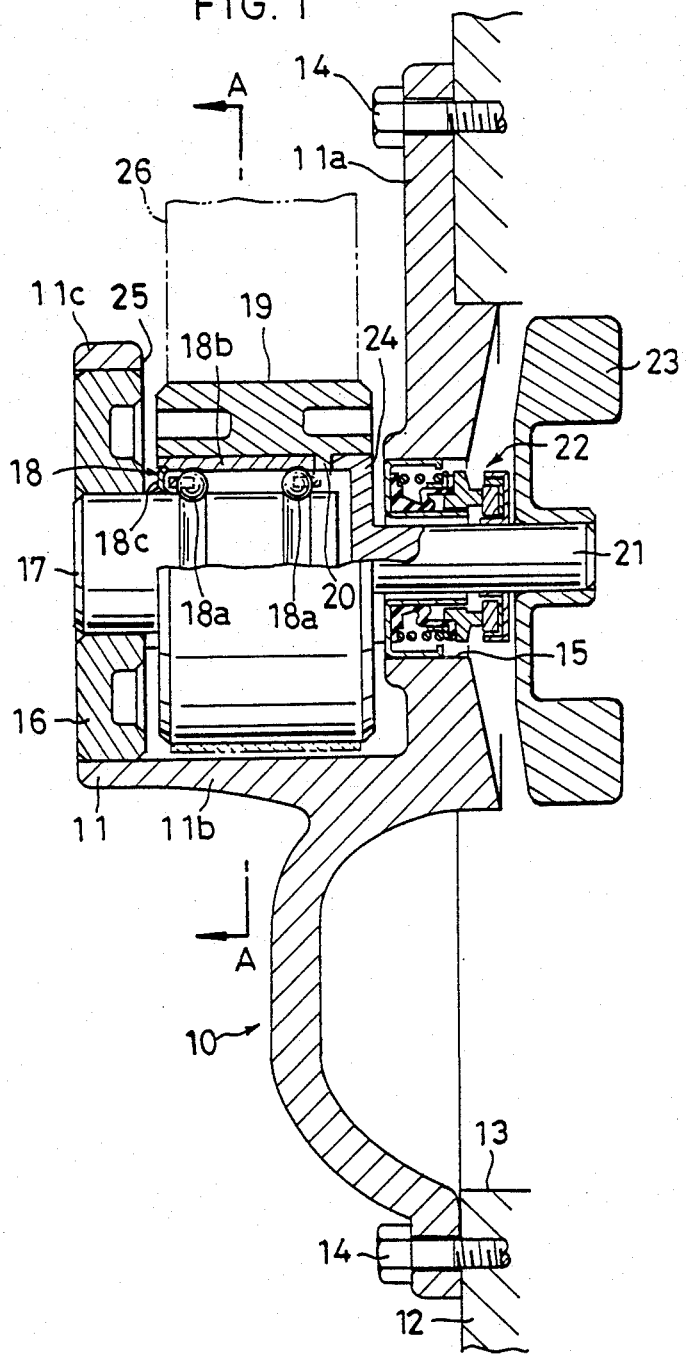
FIG. 1 is a side elevation partly broken away and showing a first embodiment of water pump according to the invention.

Embodiments of the present invention for use as water pumps for motor vehicles will be described below with reference to the accompanying drawings. Throughout these drawings, like parts are designated by like reference numerals or symbols.

FIG. 1 shows a first embodiment. In the following description, the terms "right" and "left" are used as referring respectively to the right and left sides of the water pump as illustrated in a side elevation as in FIG. 1.

The illustrated water pump 10 has a pump housing 11 which comprises a right end wall 11*a* fastened by bolts 14 to the left end of an engine body 12 to close an opening 13 therein, and a peripheral wall 11*b* integral with the central portion of the wall 11*a* on the right side thereof and generally in the form of a hollow cylinder which is partly cut out as will be described later. A circular hole 15 is formed in the end wall 11*a* concentrically with the peripheral wall 11*b*. An end plate 16 is secured to the housing 11 at its left end opposite to the right end wall 11*a*. A stationary shaft 17 secured at its left end to the center of the end plate 16 is aligned with the hole 15 of the end wall 11*a* and extends in the housing 11 to a position close to the hole 15. A pulley 19 is rotatably provided around the stationary shaft 17 and supported thereon by an antifriction bearing 18 including balls 18*a* in two rows. The pulley 19 is integrally formed on its inner periphery with an annular projection 20 positioned closer to its right end. The outer ring 18*b* of the bearing 18 is press-fitted in the pulley 19 at the left side of the projection 20. The stationary shaft 17 serves also as the inner ring of the bearing 18. Thus, the inner ring of the bearing 18 is integral with the stationary shaft 17 and provides the outer surface of the shaft 17. A seal 18*c* is provided at the left end of the bearing 18, but no seal is disposed at the right end thereof.

A pump shaft 21 in alignment with the shaft 17 rotatably extends through the center of the hole 15 in the right end wall 11*a* of the housing 11, with a mechanical seal 22 interposed therebetween. The pump shaft 21 has a right end portion projecting into the engine body 12 beyond the outer surface of the housing end wall 11*a*. An impeller 23 is fixedly mounted on the shaft end. The left end of the pump shaft 21 is projected slightly into the housing 11 beyond the inner surface of the housing end wall 11*a* and positioned close to the right end of the stationary shaft 17. The left end of the shaft 21 is integrally formed with a water-tight flange 24 extending outward radially thereof and immediately adjacent to the outer side of the mechanical seal 22. The flange 24 is secured to the pulley 19 by being press-fitted therein at the right side of the projection 20. When the outer ring 18*b* of the bearing 18 and the flange 24 of the pump shaft 21 are secured to the pulley 19 by a press fit, the projection 20 on the inner periphery of the pulley 19 serves to position them in place. Since the length of the fit between the pulley 19 and the flange 24 is short, the surfaces to be fitted to each other preferably have suitable irregularities or projections to preclude rotation relative to each other. The fitting surfaces of the pulley 19 and the outer ring 18*b* of the bearing 18 have a large length and therefore may be free of irregularities or the like.

Figure 2:
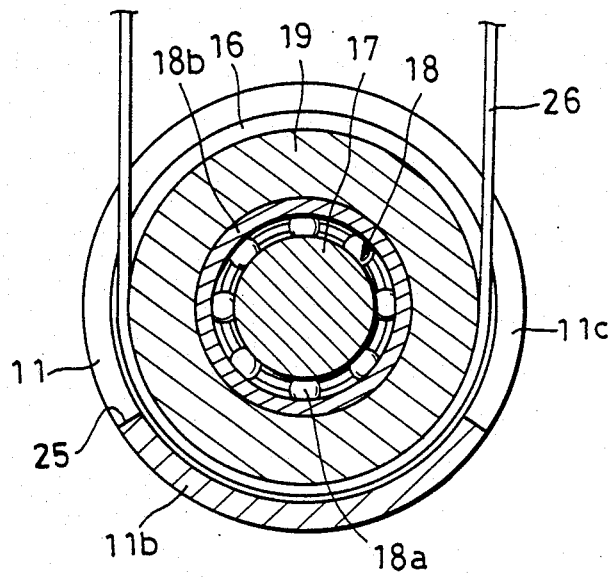
FIG. 2 is a view in section taken along the line A—A in FIG. 1.

The generally cylindrical peripheral wall 11*b* of the housing 11 is cut out over an area of more than the upper half thereof except for a hollow cylindrical portion 11*c* at its left end. The peripheal wall 11*b* generally in the form of a portion of a hollow cylinder and positioned below the cutout portion 25 covers the pulley 19 from below. The end plate 16 is fixedly fitted in the cylindrical portion 11*c* at the left end of the housing 11. As seen in FIG. 2, a belt 26 inserted in the housing 11 through the upper-side cutout portion 25 of the housing 11 is reeved around the lower portion of the pulley 19.

The water pump 10 of the first embodiment is of the type wherein the outer ring of the bearing 18 is rotatable, such that when the belt 26 is driven, the pulley 19 secured to the outer ring 18*b* of the bearing 18 rotates around the stationary shaft 17, causing the flange 24 to rotate the pump shaft 21, which in turn rotates an impeller 23 fixed thereto for circulating cooling water.

Since the watertight flange 24 secured to the pump shaft 21 and the pulley 19 is positioned between the mechanical seal 22 and the bearing 18, the water vapor passing through the mechanical seal 22 is completely prevented from ingressing into the bearing 18 upon condensation. Further since the pulley 19 is positioned around the bearing 18, the load applied by the belt 26 acts on the bearing 18 approximately at its center, precluding a bending force from acting on the bearing 18. Accordingly, the bearing 18 is serviceable for a prolonged period of time and can be small-sized and lightweight. The outer ring 18*b* of the bearing 18, the pulley 19 and the flange 24, which are all prepared separately, can be machined easily with improved accuracy.

The housing 11, pulley 19, mechanical seal 22, impeller 23, etc. are not limited to those of the above embodiment in construction but can be modified suitably. For example, the housing can be integral in its entirety. The outer periphery of the pulley may be smooth-surfaced or grooved circumferentially or axially thereof.

Figure 3:
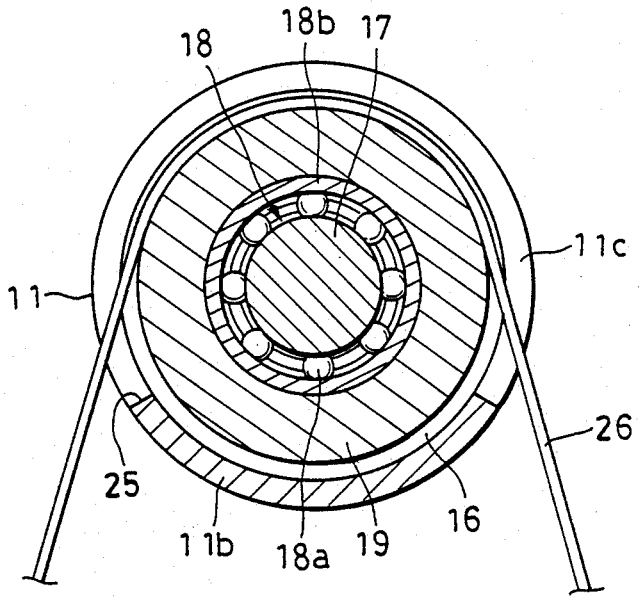
FIG. 3 is a view corresponding to FIG. 3 and showing a belt as reeved around a pulley in a different mode.

FIG. 3 shows a modified mode of reeving the belt 26 around the pulley 19. In this case, the belt 26 is passed around the housing 11 and reeved around the pulley 19 over the upper portion thereof left uncovered with the housing at the cutout portion 25. This mode eliminates the need to place the belt 26 in the housing 11 in advance; the belt 26 can be placed over the pulley after the water pump 10 has been installed in position.

Figure 4:
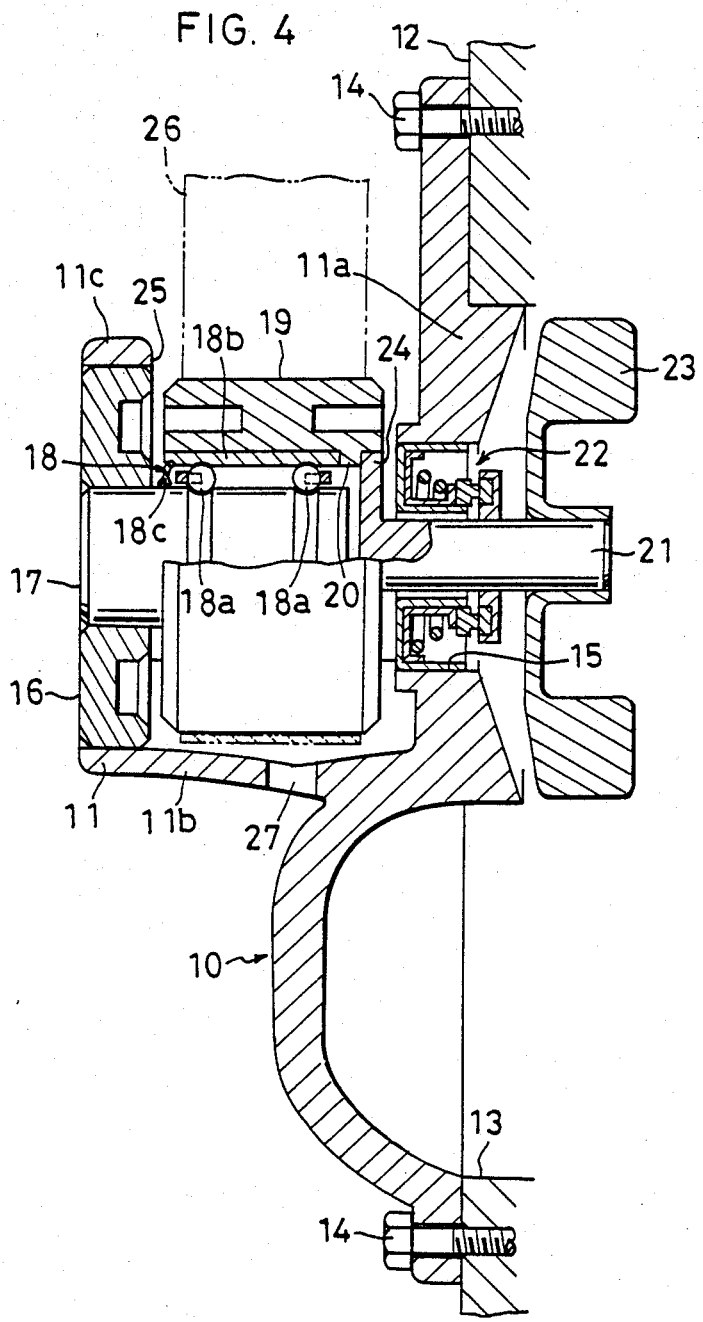
FIG. 4 is a side elevation partly broken away and showing a second embodiment of water pump according to the invention.

FIG. 4 shows a second embodiment, wherein the peripheral wall **11*b* of the housing 11 is so tapered as to have a slightly increased inside diameter toward the engine body 12 (right side). The inner surface of the lowermost portion of the wall 11*b* is inclined downward toward the engine body 12. The peripheral wall 11*b* has a drain port 27 in the lowermost portion close to the engine body 12**.

The water passing through the mechanical seal 22 falls onto the inner surface of the peripheral wall **11*b* which is generally in the form of part of a hollow cylinder and positioned at the lower portion of the housing 11. The water then flows down the inclined inner wall surface toward the engine body 12 and is drawn out through the drain port 27 without remaining in the housing 11. This obviates the likelihood that on vaporization, the water will penetrate into the bearing 18 at the seal portion 18*c***.

Even when the peripheral wall **11*b* at the lower portion of the housing 11 is formed with the drain port 27, the wall 11*b*** may have a straight cylindrical inner surface as in the first embodiment. More than one drain port may be provided. The housing peripheral wall may have a relatively large drain hole, such as a drain slot, which will not exert an influence on the strength of the housing. The drain port may be so shaped as to spread out toward the direction of travel of the belt (e.g. triangular shape) or to incline in a circumferential direction in the direction of travel of the belt radially outwardly of the peripheral wall. The water scattered under the air pressure produced by the travel of the belt will then be discharged quickly through the drain port.

Figure 5:
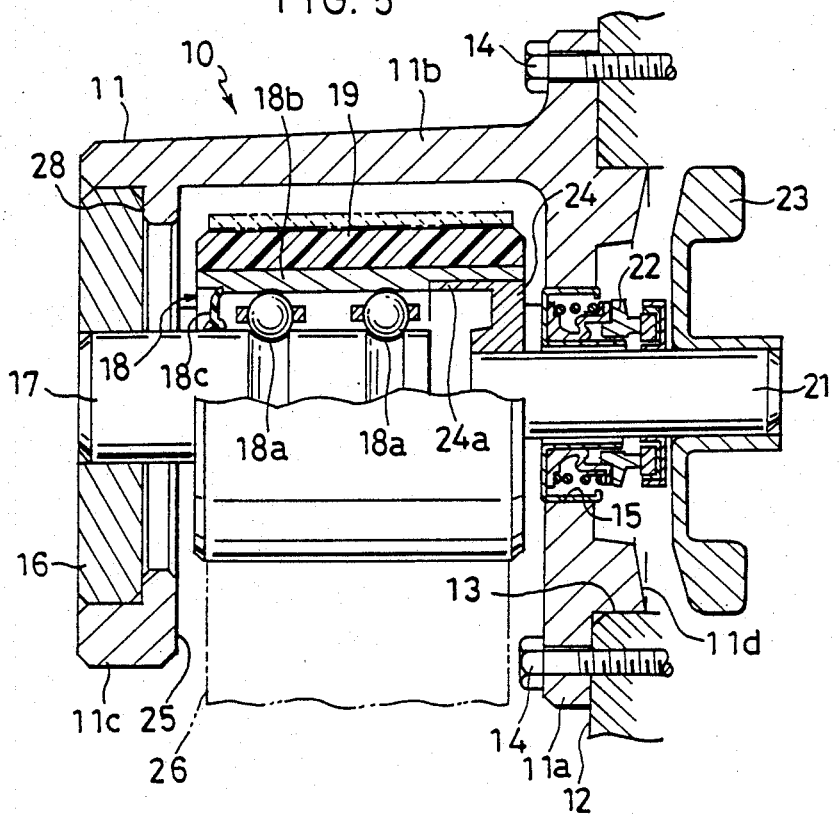
FIG. 5 is a side elevation partly broken away and showing a third embodiment of water pump according to the invention.
Figure 6A:
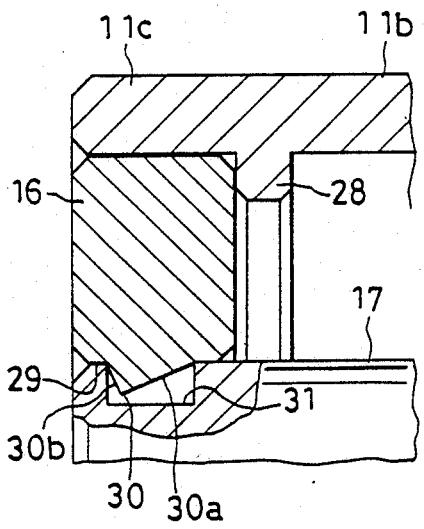
FIG. 6 (*a*) and 6 (*b*) show part of FIG. 5 on an enlarged scale.
Figure 6B:
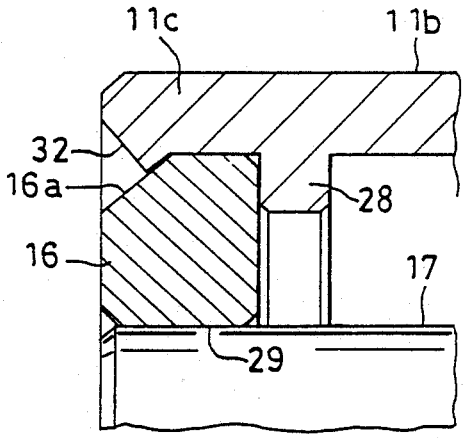

FIGS. 5 and 6 show a third embodiment, wherein the housing peripheral wall **11*b* is cut out over an area of more than the lower half thereof except for the leftend cylindrical portion 11*c*. The remaining wall upper portion 11*b* of the housing 11 is generally in the form of part of a hollow cylinder to cover the pulley 19 from above. The belt 26 inserted in the housing 11 through the lower cutout portion 25 of the housing 11 is reeved around the pulley 19 over the upper portion thereof. The cylindrical portion 11*c* at the left end of the housing 11 is formed on its inner periphery with an annular projection 28 integral therewith and positioned at the right end of the portion 11*c*. The end plate 16 is secured to the inner periphery at the left side of the projection 28. The housing has a right end wall 11*a* which is slightly larger than the peripheral wall 11*b* in outside diameter. The end wall 11*a* is integrally formed with a short hollow cylindrical portion 11*d* concentric with the hole 15 and provided on the outer surface of the wall 11*a*. The short cylindrical portion 11*d* is fitted in the opening 13 of the engine body 12. The watertight flange 24 of this embodiment is prepared separately from the pump shaft 21 and secured in place by suitable means as by a press fit. The outer peripheral portion of the flange 24 is integrally formed with a hollow cylindrical portion 24*a* extending toward the stationary shaft 17 (i.e. leftward). The cylindrical portion 24*a* is secured to the right end of the outer ring 18*b* of the bearing 18 by a press fit. A pulley 19 made of synthetic resin is fixedly joined to the outer periphery of the outer ring 18*b* of the bearing 18. The pulley 19 may be formed around the bearing outer ring 18*b* by injection molding. Alternatively, the pulley may be molded first and then internally machined for fixing the outer ring 18*b* of the bearing 18** therein by a press fit.

FIG. 6 shows two examples of structures for securing the end plate 16 to the housing cylindrical portion **11*c* and to the stationary shaft 17**.

Figure 16:
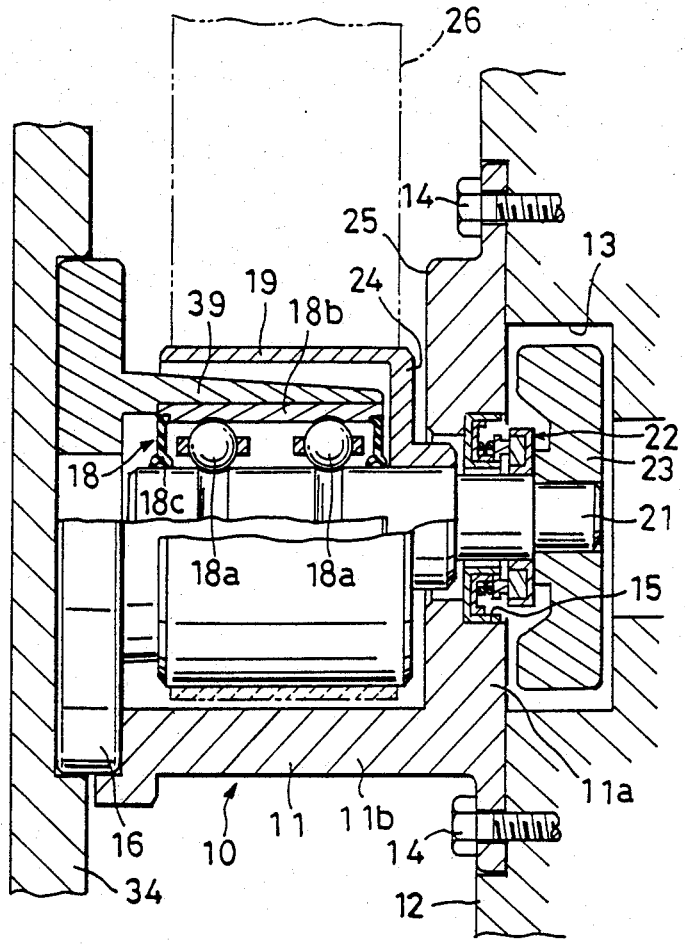
FIG. 16 is a side elevation partly broken away and showing an twelfth embodiment of water pump according to the invention.

In the case of FIG. 16, (*a*), the end plate 16 is secured to the housing cylindrical portion **11*b* by a press fit. The inner periphery of the end plate 16 defining a bore 29 is integrally formed with an annular ridge 30 having a triangular section. An annular groove 31 having a rectangular section is formed in the outer periphery of the stationary shaft 17 opposed to ridge 30. The two members are fixed together by pressing the left end of the stationary shaft 17 into the bore 29 of the end plate 16 from right side to fit the ridge 30 into the groove 31. To press the shaft 17 into the end plate 16 with ease, the tapered face 30*a* on the right side of the ridge 30 has a small taper angle. To prevent the shaft 17 from slipping off, the left tapered face 30*b* of the ridge 30 has a large taper angle. The groove 31** is not always rectangular in section but can be triangular or semicircular or otherwise shaped.

The stationary shaft 17, when merely pressed in, is likely to slip off when subjected to variations in load, vibration or the like, consequently breaking the water pump 10. With the structure shown in FIG. 6, (*a*), however, the engagement of the ridge 30 of the end plate 16 in the groove 31 of the shaft 17 precludes the shaft 17 from slipping off to reliably protect the water pump 10 against damage or break.

In the case of FIG. 6, (*b*), the stationary shaft 17 is secured by being pressed in. The left outer peripheral edge of the end plate 16 is relatively greatly chamfered as at **16*a*. After the end plate 16 has been pressed into the cylindrical portion 11*c* of the housing 11, the left end of the portion 11*c* is crimped at suitable locations or over the entire circumference to clamp the outer peripheral portion of the end plate 16 between the crimped portion 32 and the projection 28** and thereby completely secure the plate to the cylindrical portion.

Usually, the pump housing 11 is made of aluminum, and the end plate 16 is prepared from steel. Since aluminum and steel differ in coefficient of expansion, the end plate 16, if merely pressed into the housing cylindrical portion **11*c*, is liable to slip off at high temperatures. Further the load applied by the belt is likely to incline and deform the end plate 16 as fitted in the cylindrical portion 11*c*, possibly causing the water pump 10 to develop a trouble. With the structure of FIG. 6**, (*b*), however, the outer peripheral portion of the end plate 16 is reliably secured to the housing cylindrical portion **11*c* by the projection 28 and the crimped portion 32, whereby the end plate 16 is effectively prevented from slipping off, inclination and deformation, rendering the water pump 10** operable free of trouble.

Figure 7:
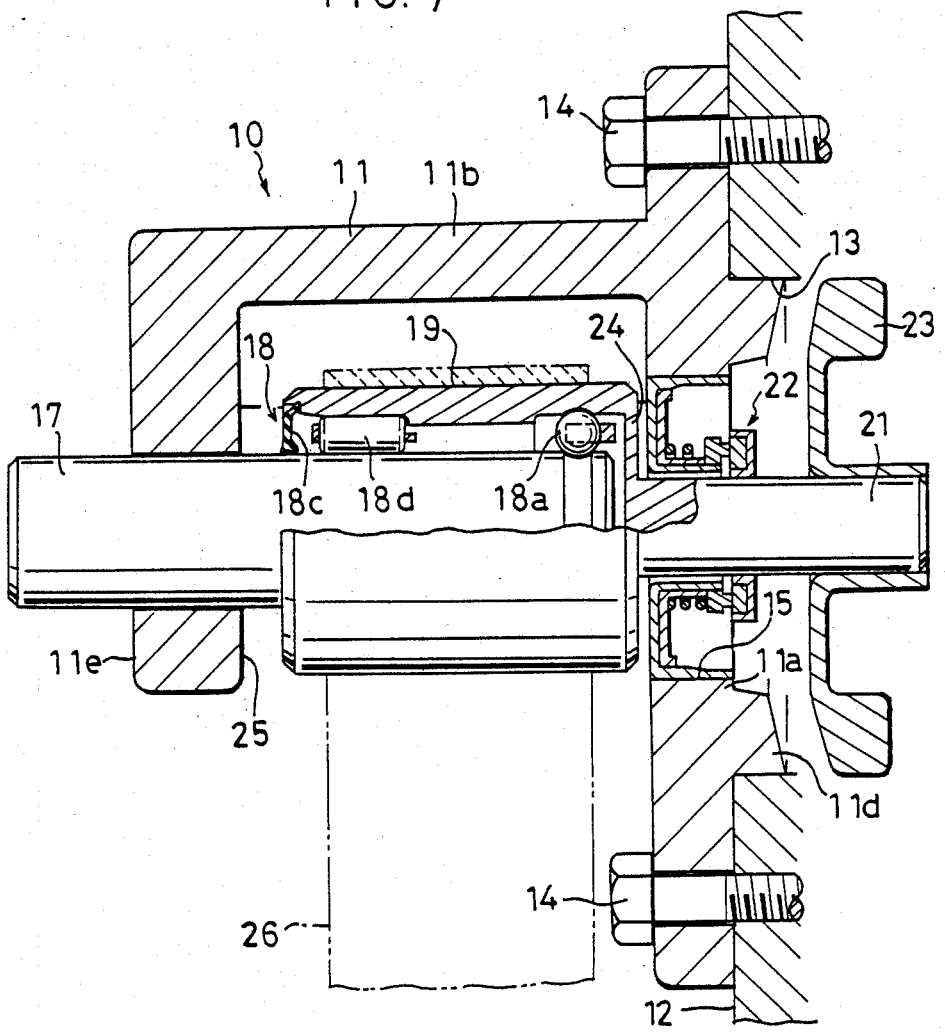
FIG. 7 is a side elevation partly broken away and showing a fourth embodiment of water pump according to the invention.

FIG. 7 shows a fourth embodiment, wherein the watertight flange 24 and the pulley 19 are formed integrally with the pump shaft 21. The bearing 18 of the embodiment comprises balls **18*a* and roller 18*d*, and the pulley 19 serves also as the outer ring of the bearing 18. More specifically, the outer ring of the bearing 18 is provided inside the pulley 19 integrally therewith. The housing 11 is integral in its entirety, and the stationary shaft 17 is secured to a left end wall 11***e* thereof. Accordingly, this embodiment comprises a decreased number of parts, is fabricated by a reduced number of steps and can be made compacter and more light-weight. When the housing 11 is in the form of an integral block, the inside diameter of the hole 15 in the right end wall 11*a* is made larger than the outside diameter of the pulley 19 for the assembly of the water pump 10.

Figure 8:
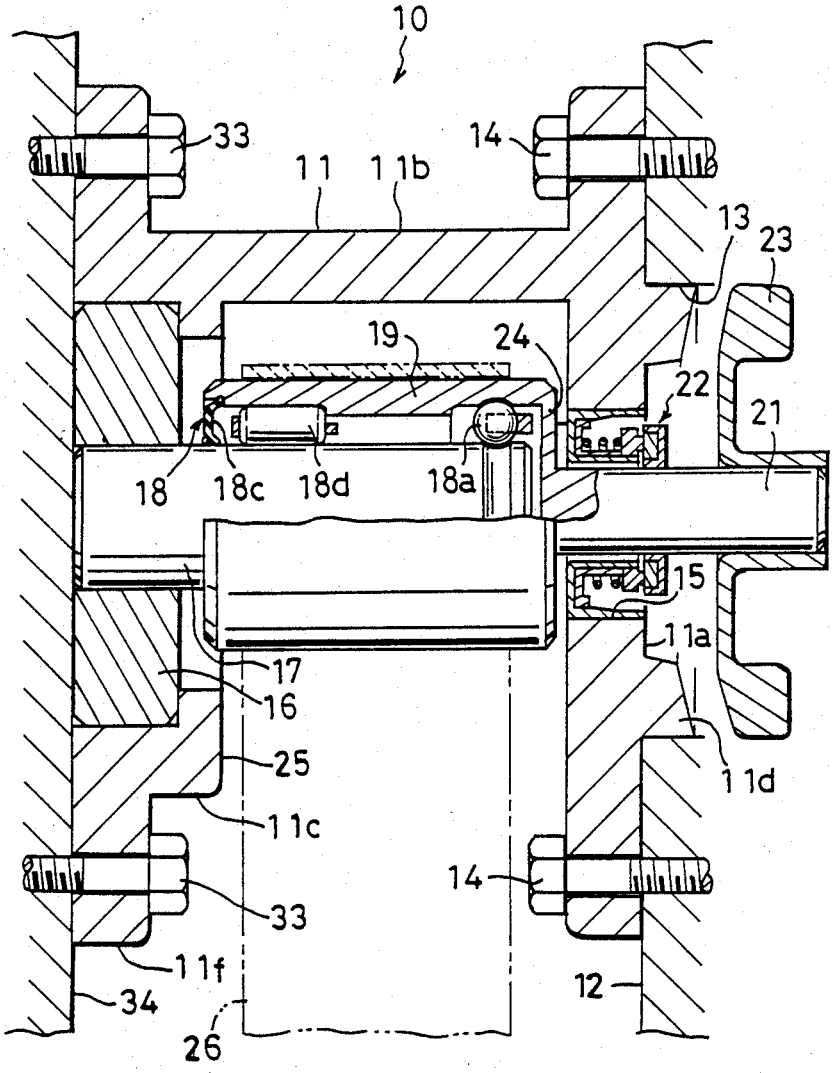
FIG. 8 is a side elevation partly broken away and showing a fifth embodiment of water pump according to the invention.

FIG. 8 shows a fifth embodiment.

Some water pumps are so construted as to be installed inside the timing belt cover of the engine, and this tendency has become pronouced recently. The fifth embodiment is also so adapted. An outward flange 11*f* is formed integrally with the cylindrical portion 11*c* of the housing 11 at its left end where the end plate 16 is provided. The flange 11*f* is fastened by bolts 33 to a flange of a timing belt cover 34. This arrangement adds to the strength of the housing 11.

Figure 9:
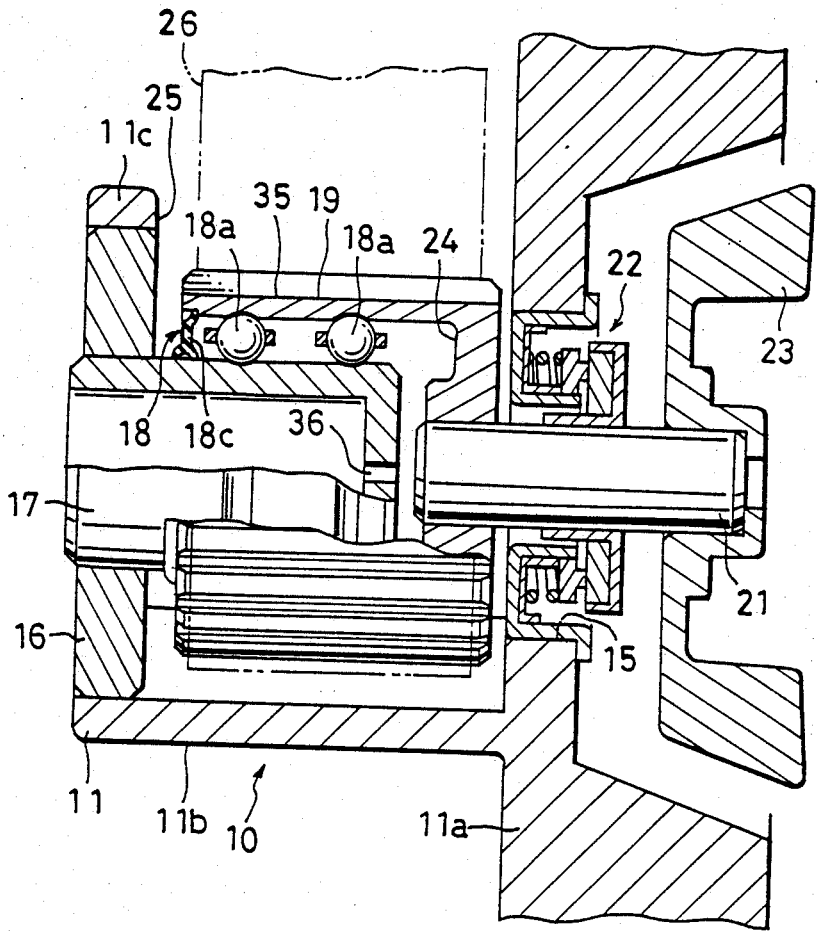
FIG. 9 is a side elevation partly broken away and showing a sixth embodiment of water pump according to the invention.

FIG. 9 shows a sixth embodiment, wherein the watertight flange 24 is secured to the left end of the pump shaft 21, and the pulley 19 is integral with the outer peripheral portion of the flange 24. Axial grooves 35 are formed in the outer periphery of the pulley 19. The pulley 19 serves also as the outer ring of the bearing 18. Since the right side of the bearing 18 closer to the impeller 23 need not be provided with any seal, the stationary shaft 17 providing the inner ring of the bearing 18 is made shorter to render the pump smaller in its entirety. Furthermore, the mechanical seal 22, which need not exhibit the performance conventionally required, is simplified to decrease the outside diameter of the pump shaft 21. The stationary shaft 17, which is hollow and open at its left end, is prepared, for example, by press work. A port 36 for releasing air therethrough is formed in an inner right side portion of the bearing 18. This structure serves to make the stationary shaft 17 lightweight and prevents the internal pressure of the bearing 18 from building up.

Figure 10:
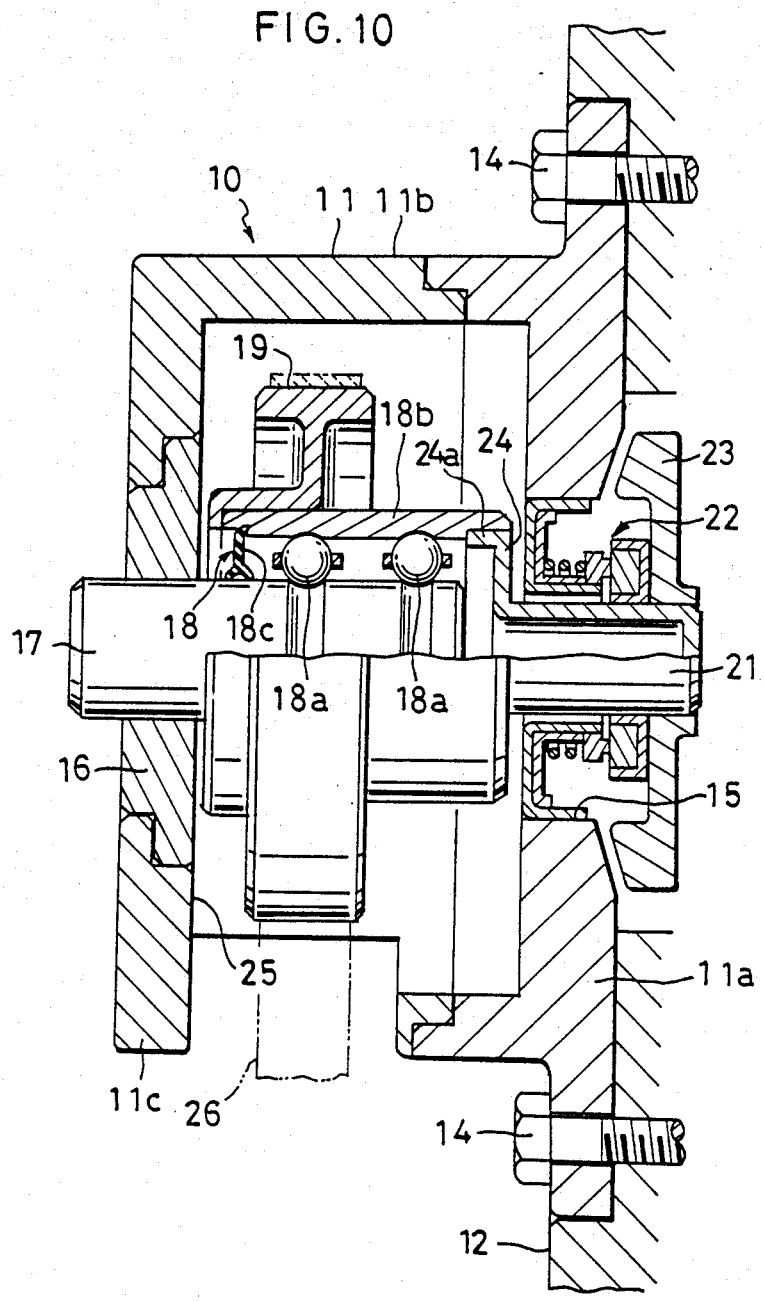
FIG. 10 is a side elevation partly broken away and showing a seventh embodiment of water pump according to the invention.

FIG. 10 shows a seventh embodiment, wherein the pump shaft 21 is hollow and open at its left end. The watertight flange 24 is integral with the open left end. A short hollow cylindrical portion 24*a* is formed integrally with the outer peripheral portion of the flange 24 and pressed in the right end of the outer ring 18*b* of the bearing 18. A pulley 19 is fitted around the left end portion of the outer ring 18*b*.

Figure 11:
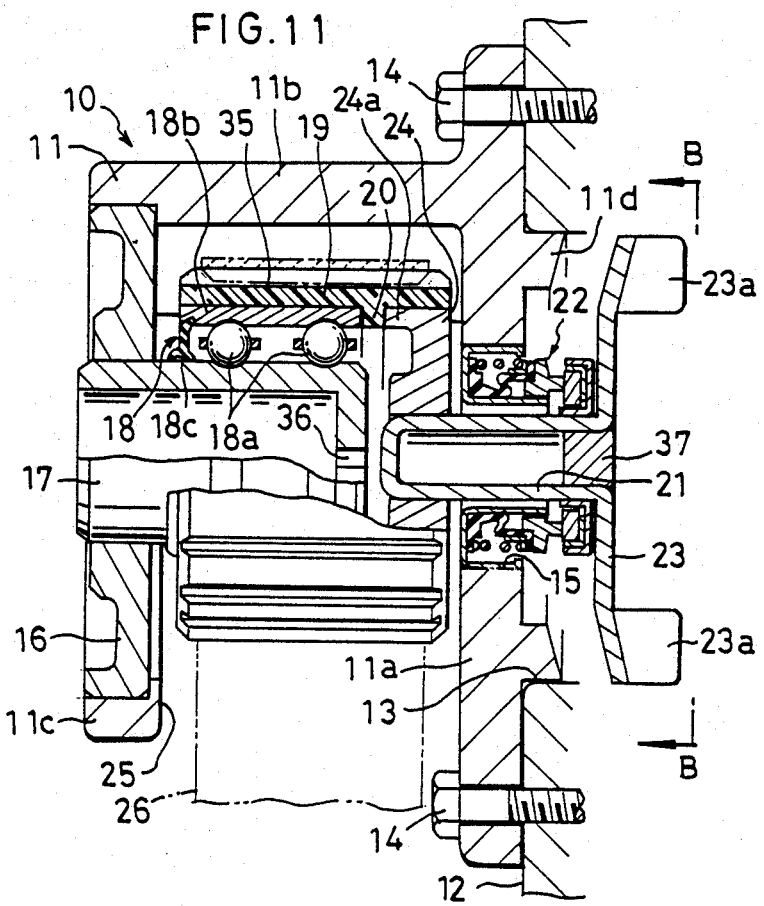
FIG. 11 is a side elevation partly broken away and showing an eighth embodiment of water pump according to the invention.
Figure 12:
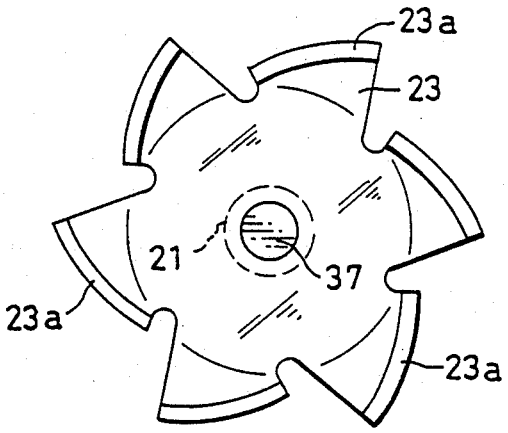
FIG. 12 is a view showing the embodiment as it is seen in the direction of arrows B—B.

FIGS. 11 and 12 show an eighth embodiment, wherein the pump shaft 21 is in the form of a hollow cylinder which is open at its right end. The pump shaft 21 extends through the right end wall 11*a* of the housing 11 into the engine body 12, in which the open right end is formed integrally with an impeller 23. The pump shaft 21 and the impeller 23 are prepared integrally by press work. The impeller 23, press-formed in a suitable shape, is bent at its outer peripheral portion to provide blades 23*a*. The open right end of the pump shaft 21 is closed with a plug 37 or the like. A watertight flange 24 is secured to the closed left end of the pump shaft 21.

The impeller 23 and the pump shaft 21 of the eighth embodiment are made integral with each other. This serves to reduce the number of components. Moreover, the integral structure of the impeller 23 and the pump shaft 21 has improved accuracy and eliminates the likelihood that the impeller 23 will slip off the pump shaft 21. The integral structure also serves to render the pump more lightweight. The pump shaft 21, watertight flange 24, pulley 19 and outer ring 18*b* of the bearing 18 are all prepared separately. This assures facilitated machining and gives improved accuracy to the product.

Figure 13:
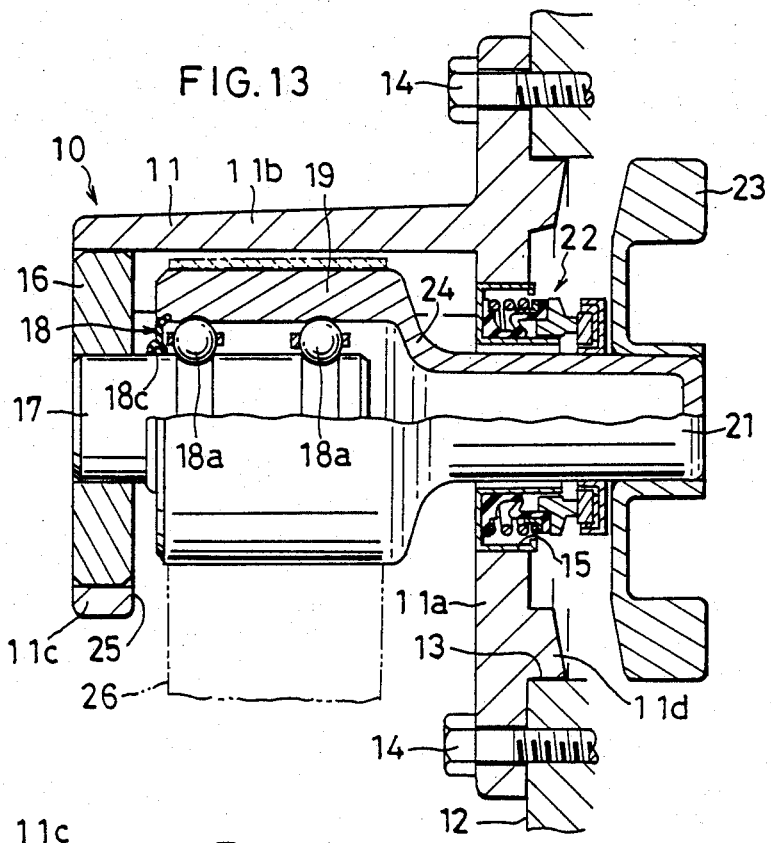
FIG. 13 and showing a ninth embodiment of water pump according to the invention.

FIG. 13 shows a ninth embodiment, wherein the pump shaft 21 is in the form of a hollow cylinder which is open at its left end. The pump shaft 21 extends through the housing end wall 11*a* into the engine body 12 and is fixedly provided at its projected right end with an impeller 23. The open left end of the pump shaft 21 is slightly projected into the housing 11 beyond the inner surface of the right end wall 11*a* of the housing 11 and positioned close to the right end of the stationary shaft 17. The left end of the shaft 21 is integrally formed with a watertight flange 24 extending radially outwardly thereof and immediately adjacent to the outer side of the mechanical seal 22. A pulley 19 serving also as the outer ring of the bearing 18 is integral with the outer peripheral portion of the flange 24. The pump shaft 21, the flange 24 and the pulley 19 are integrally formed by press work. The stationary shaft 17 serves also as the inner ring of the bearing 18.

In the case of the ninth embodiment, the pulley 19 serving also as the outer ring of the bearing 18, the watertight flange 24 and the pump shaft 21 are prepared in the form of an integral piece. This reduces the number of components. Since the integral piece is made by press work, the pump can be produced at a lower cost and made lightweight.

Figure 14:
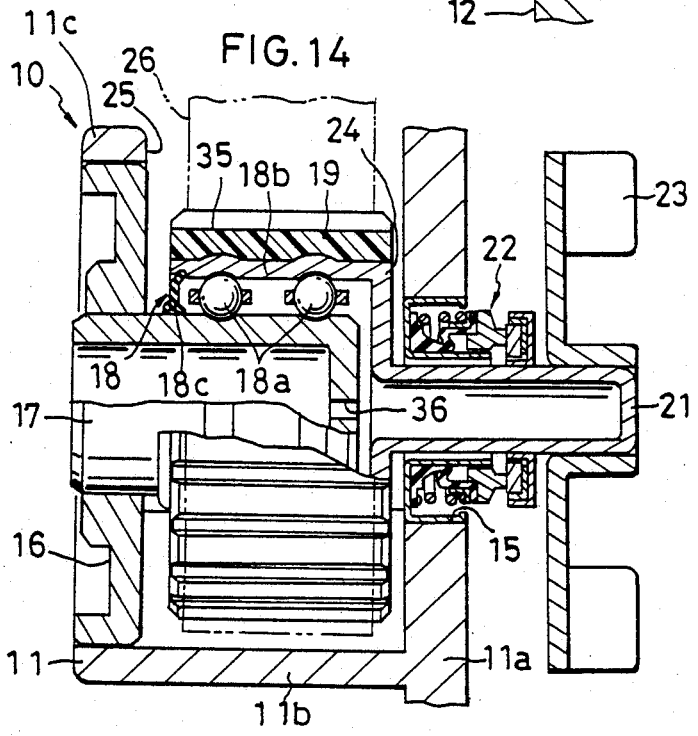
FIG. 14 is a side elevation partly broken away and showing a tenth embodiment of water pump according the invention.

FIG. 14 shows a tenth embodiment, wherein the pump shaft 21 which is hollow, watertight flange 24 and the outer ring 18*b* of bearing 18 are integrally formed by press work. A pulley 19 of synthetic resin prepared separately from the bearing outer ring 18*b* is fixedly provided around the ring 18*b* by suitable method as by injection molding or pressing in.

Figure 15:
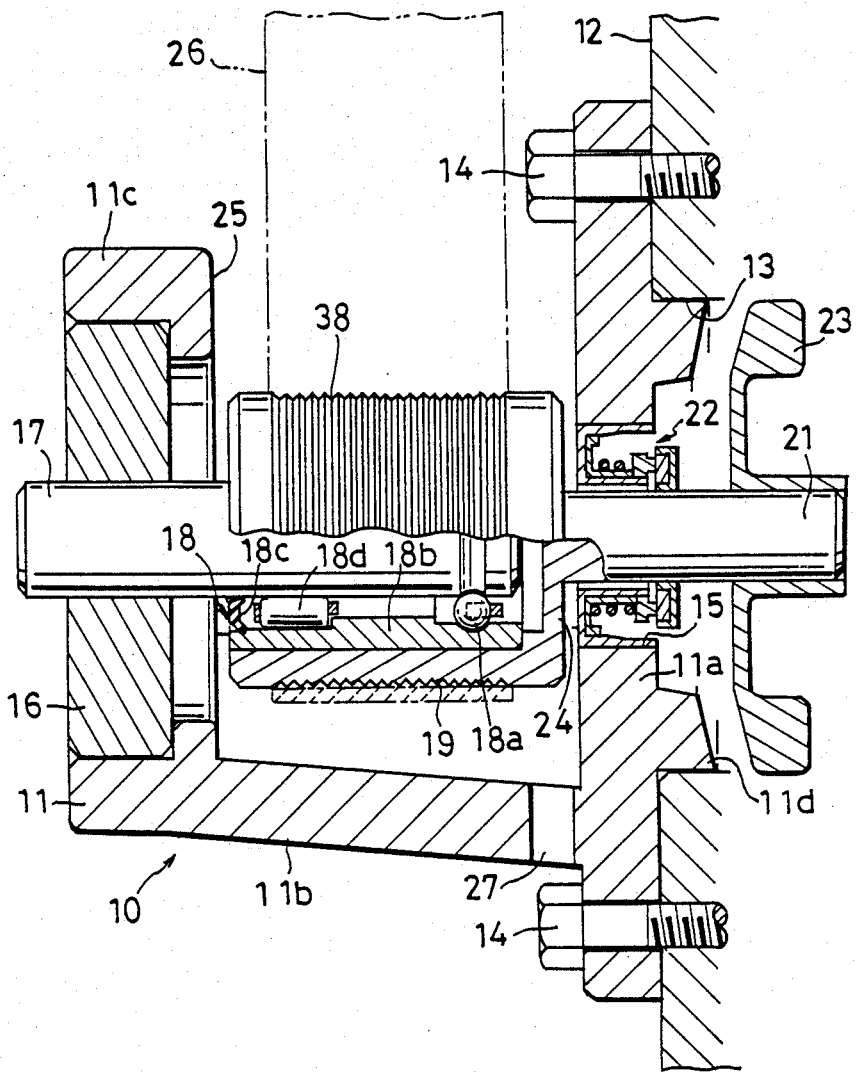
FIG. 15 is a side elevation partly broken away and showing an eleventh embodiment of water pump according to the invention.

FIG. 15 shows an eleventh embodiment, wherein the watertight flange 24 and pulley 19 are integral with the pump shaft 21. The outer ring 18*b* of an antifriction bearing 18 is pressed in the pulley 19. Circumferential grooves 38 are formed in the outer periphery of The water pumps 10 according to the second to eleventh embodiments are of the type wherein the bearing outer ring is rotatable.

FIG. 16 shows a twelfth embodiment, wherein the pump housing 11 is fastened to the engine body 12 and to a timing belt cover 34. A stationary sleeve 39 projecting into the housing 11 from the inner surface of the end plate 16 is integral with the plate 16. The pump shaft 21 is projected into the stationary sleeve 39 from the inner surface of the right end wall 11*a* of the housing 11. An antifriction bearing 18 is provided between the sleeve 39 and the shaft 21. The outer ring 18*b* of the bearing 18 is pressed in the sleeve 39. The pump shaft 21 serves also as the bearing inner ring. Between the mechanical seal 22 and the bearing 18, a watertight seal 24 is fixedly provided around the outer surface of the pump shaft 21, and a pulley 19 is integral with the outer peripheral portion of the flange 24. Approximately upper half of the housing 11 is cut out as at 25 to pass a belt 26 through the cutout portion 25.

The water pump of the twelfth embodiment is of the type wherein the bearing inner ring is rotatable. When the belt 26 is driven to rotate the pulley 19, the pump shaft 21 providing the inner ring of the bearing 18 rotates to thereby rotate an impeller 23.

In the case of the twelfth embodiment, a drain port can be formed in a suitable portion of the peripheral wall 11*b* at the lower portion of the housing 11.

What is claimed is:

1. A water pump comprising a pump shaft having an impeller and mounted on one end portion of a pump housing with a seal provided therebetween, a stationary shaft in alignment with the pump shaft and supported at its one end by the other end portion of the pump housing, a pulley for reeving a belt therearound provided around the outer ring of an antifriction bearing mounted around the stationary shaft within the pump housing, and a watertight flange positioned between the seal and the antifriction bearing and fixedly provided between the end portion of the pump shaft and the end portion of the pulley.

2. A water pump as defined in claim 1 wherein the pump shaft, the watertight flange and the pulley are formed integrally by press work.

3. A water pump as defined in claim 1 wherein the pulley is prepared separately from and integrally secured to the outer ring of the antifriction bearing, and the watertight flange is prepared separately from the outer ring of the antifriction bearing and the pulley and integrally secured to the pulley, the pump shaft being fixedly provided on the watertight flange.

4. A water pump as defined in claim 1 wherein the impeller and the pump shaft are formed integrally by press work.

5. A water pump as defined in claim 1 wherein the inner ring of the antifriction bearing is provided around the stationary shaft integrally therewith.

6. A water pump as defined in claim 1 wherein the pump housing has a peripheral wall which is partly cut out, and the belt is inserted in the pump housing through the cutout portion and reeved around the pulley.

7. A water pump as defined in claim 1 wherein the pump housing has a peripheral wall which is partly cut out, and the belt is passed around the pump housing and reeved around the pulley over the portion thereof left uncovered with the housing at the cutout portion.

8. A water pump as defined in claim 1 wherein the pump housing has a peripheral wall generally in the form of a portion of a hollow cylinder and covering the pulley from below, and a drain port is formed in the peripheral wall in the vicinity of its lowermost portion.

* * * * *